US010004320B2

(12) United States Patent
Reid et al.

(10) Patent No.: US 10,004,320 B2
(45) Date of Patent: Jun. 26, 2018

(54) HIPBELT SUSPENSION SYSTEM FOR USE WITH A BACKPACK

(71) Applicant: Amer Sports Canada Inc., North Vancouver (CA)

(72) Inventors: Lawrence Reid, Gibsons (CA); Catherine Brown, Gibsons (CA); Timothy Babcock, Vancouver (CA); John Atkinson, North Vancouver (CA)

(73) Assignee: Amer Sports Canada Inc., North Vancouver (CA)

( * ) Notice: Subject to any disclaimer, the term of this patent is extended or adjusted under 35 U.S.C. 154(b) by 90 days.

(21) Appl. No.: 15/150,837

(22) Filed: May 10, 2016

(65) Prior Publication Data

US 2017/0325572 A1 Nov. 16, 2017

(51) Int. Cl.

| | |
|---|---|
| ***A45F 3/04*** | (2006.01) |
| ***A45F 3/08*** | (2006.01) |
| *A45F 3/00* | (2006.01) |

(52) U.S. Cl.

CPC ..... *A45F 3/04* (2013.01); *A45F 3/047* (2013.01); *A45F 3/08* (2013.01); *A45F 2003/007* (2013.01); *A45F 2003/045* (2013.01)

(58) Field of Classification Search

CPC .... A45F 3/047; A45F 3/04; A45F 3/08; A45F 2003/007

USPC ..... 224/637

See application file for complete search history.

(56) References Cited

U.S. PATENT DOCUMENTS

| | | | | |
|---|---|---|---|---|
| 629,011 | A | 7/1889 | Miller | |
| 3,355,075 | A | 11/1967 | Dean | |
| 3,710,409 | A | 1/1973 | Davidson | |
| 4,676,418 | A * | 6/1987 | Lowe | A45F 3/08 224/262 |
| 4,836,426 | A | 6/1989 | Munn et al. | |
| 5,004,135 | A * | 4/1991 | Dufournet | A45F 3/047 224/262 |
| 5,184,764 | A | 2/1993 | Orovan et al. | |
| 6,079,602 | A * | 6/2000 | Howell | A45F 3/047 224/262 |
| 6,158,380 | A | 12/2000 | Aschauer et al. | |
| 6,270,386 | B1 | 8/2001 | Visocekas | |
| 6,298,487 | B1 | 10/2001 | Mayhew | |

(Continued)

FOREIGN PATENT DOCUMENTS

| | | | | |
|---|---|---|---|---|
| DE | 19803729 A1 * | 8/1999 | | A45F 3/047 |
| DE | 202013004306 * | 8/2014 | | A45F 3/042 |

(Continued)

*Primary Examiner* — Justin Larson

(74) *Attorney, Agent, or Firm* — Terence P. O'Brien

(57) ABSTRACT

A hipbelt suspension system for use with a backpack having a back panel includes a back panel, a generally planar hipbelt coupling element, a hipbelt support plate and a hipbelt. The back panel support is coupled a lower region of the back panel. The back panel support includes an engagement region having opposing first and second stops. The hipbelt coupling element movably engages the engagement region of the back panel support to enable translational movement of the hipbelt coupling element between the first and second stops of the engagement region of the back panel. A hipbelt attachment mechanism pivotally coupled to the hipbelt coupling element about a first axis. A hipbelt is secured to the hipbelt attachment mechanism.

25 Claims, 13 Drawing Sheets

(56) References Cited

U.S. PATENT DOCUMENTS

| | | | | |
|---|---|---|---|---|
| 6,634,533 | B2 * | 10/2003 | Thompson | A45F 3/047 224/262 |
| 7,270,077 | B2 | 9/2007 | Beck | |
| 7,878,141 | B2 | 2/2011 | Paynton et al. | |
| 8,172,117 | B2 | 5/2012 | Maggi | |
| 8,182,439 | B2 * | 5/2012 | Glenn | F41H 1/02 224/637 |
| 8,312,600 | B2 * | 11/2012 | Colorado | A62B 9/04 224/637 |
| 8,494,480 | B2 | 7/2013 | Aschauer et al. | |
| 8,584,917 | B2 * | 11/2013 | Hexels | A45F 3/08 2/102 |
| 8,714,424 | B2 * | 5/2014 | Oddou | A45F 3/04 224/262 |
| 8,777,684 | B2 | 7/2014 | Grutta et al. | |
| 8,851,948 | B2 | 10/2014 | Grutta et al. | |
| 8,851,949 | B2 | 10/2014 | Grutta et al. | |
| 8,876,568 | B2 | 11/2014 | Blenkarn et al. | |
| 9,004,116 | B2 | 4/2015 | Walker et al. | |
| 9,220,333 | B2 * | 12/2015 | Losos | A45F 3/10 |
| 9,272,187 | B2 | 3/2016 | Blenkarn et al. | |
| 2005/0045686 | A1 * | 3/2005 | Yeh | A45F 3/047 224/632 |
| 2008/0035686 | A1 | 2/2008 | Gregory | |
| 2010/0243694 | A1 * | 9/2010 | Oddou | A45F 3/04 224/633 |
| 2013/0146175 | A1 | 6/2013 | Walker et al. | |
| 2013/0149923 | A1 | 6/2013 | Walker et al. | |
| 2014/0151424 | A1 * | 6/2014 | Hexels | A45F 3/06 224/637 |
| 2014/0345604 | A1 | 11/2014 | Wang et al. | |

FOREIGN PATENT DOCUMENTS

| | | | | |
|---|---|---|---|---|
| EP | 1880630 | A2 * | 1/2008 | A45C 13/30 |
| EP | 1948323 | | 7/2008 | |
| FR | 2664139 | A1 * | 1/1992 | A45F 3/047 |
| FR | 2670096 | A1 * | 6/1992 | A45F 3/047 |
| JP | 02194288 | A * | 7/1990 | A45F 3/047 |
| JP | 06022817 | A * | 2/1994 | A45F 3/047 |
| JP | 06121704 | A * | 5/1994 | A45F 3/047 |
| JP | 09010036 | A * | 1/1997 | A45F 3/047 |
| JP | 2004121794 | | 4/2004 | |

* cited by examiner

HIPBELT SUSPENSION SYSTEM FOR USE WITH A BACKPACK

FIELD OF THE INVENTION

The present invention relates to a backpack assembly for a user, and a hipbelt suspension system for use with a backpack.

BACKGROUND OF THE INVENTION

Backpacks are well-known and are commonly used for carrying personal items, safety gear, sporting goods and other products for outdoor activities, sporting events, and other uses. Backpacks typically include one or more storage compartments and a pair shoulder straps. Larger backpacks typically also include an additional strap extending from a lower portion of the backpack for attachment to a user waist and/or hips, commonly referred to a hipbelt.

Although hipbelts facilitate a user's ability to carry a large backpack and help prevent the backpack from moving out of position or swinging from side to side when worn by the user, such backpacks include drawbacks. Many existing backpacks with hipbelts provide little or no adjustably. As a result, the load exerted upon a user of such backpacks can stress the user's hips, lower back or legs. It is common for many user's pelvic bone and/or hips to moves slightly up and down while walking, hiking or climbing with a backpack, particularly on uneven terrain. Existing backpacks typically do not account for such motion, which can make the backpack uncomfortable for many users to wear, particular for an extended period of time.

Accordingly, a need exists for a backpack assembly that includes a hipbelt that adjusts to the user. What is needed is a backpack design that enables a user to comfortably wear or carry the backpack even over an extended period of time. It would be desirable to provide an improved hipbelt suspension system for a backpack that is easy to use, readily adjustable and an enhanced freedom of movement or range of motion.

SUMMARY OF THE INVENTION

According to a principal aspect of a preferred form of the invention, a backpack assembly for a user includes a back panel including an upper region and a lower region, a pack body coupled to the back panel, a back panel support, a hipbelt coupling element, a hipbelt and a hipbelt attachment mechanism. The body includes one or more compartments. The back panel support is coupled the lower region of the back panel. The back panel support includes an elongate engagement region having opposing first and second stops. The hipbelt coupling element movably engages the elongate engagement region of the back panel support such that the coupling element is free to move between the first and second stops of the engagement region. The hipbelt attachment mechanism is pivotally coupled to the hipbelt coupling element about a first axis.

According to another principal aspect of a preferred form of the invention, a hipbelt suspension system for use with a backpack having a back panel includes a back panel, a generally planar hipbelt coupling element, a hipbelt attachment mechanism, and a hipbelt. The back panel support is coupled a lower region of the back panel. The back panel support includes an engagement region having opposing first and second stops. The hipbelt coupling element movably engages the engagement region of the back panel support to enable translational movement of the hipbelt coupling element between the first and second stops of the engagement region of the back panel. A hipbelt support plate pivotally coupled to the hipbelt coupling element about a first axis. A hipbelt is secured to the hipbelt attachment mechanism.

This invention will become more fully understood from the following detailed description, taken in conjunction with the accompanying drawings described herein below, and wherein like reference numerals refer to like parts.

DETAILED DESCRIPTION OF THE INVENTION

Figure 1:
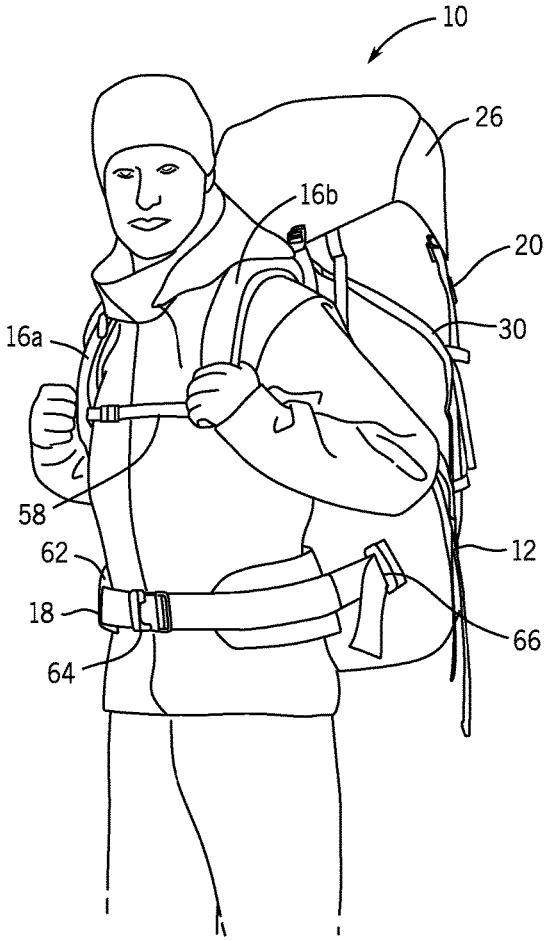
FIG. 1 is a front, side perspective view of a backpack being worn by a user.
Figure 2:
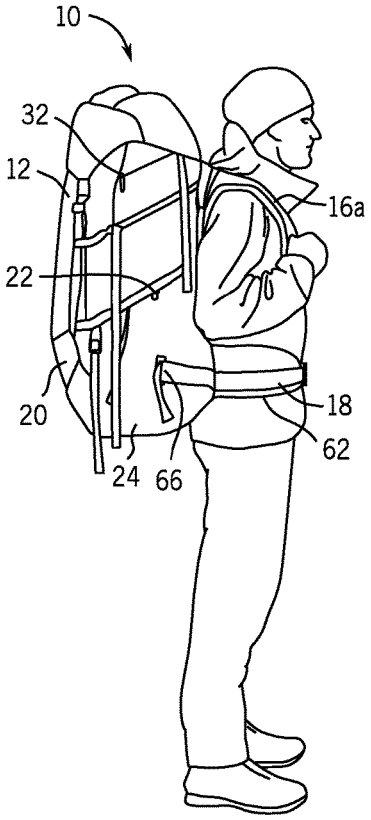
FIG. 2 is a side view of the backpack of FIG. 1.

Referring to FIGS. 1 through 3, a backpack in accordance with one implementation of the present invention is generally indicated at 10. Although FIGS. 1 through 3 illustrate a backpack, the present invention can be formed as a harness, a vest or a jacket. The backpack 10 includes a pack body 12, a back panel 14, a pair of shoulder straps 16*a* and 16*b* and a hipbelt 18. The pack body 12 alone, or with the back panel 14, can form one or more storage compartments 20 for storing and transporting outdoor gear, personal items, safety gear and/or other types of goods. Backpacks include a variety of shapes, sizes, weights, lengths and widths depending upon a particular application, a particular user or an intended purpose. Backpacks 10 that include hipbelts 18 can be sized to have a volume within the range of 10 to 120 liters, and a weight within the range of 16 to 120 ounces. In more particular implementations, the backpacks 10 can have a volume of 18 to 97 liters, and a weight within the range of 16 to 95 ounces. In still other implementations, volumes and/or weights outside of these ranges can also be used.

The pack body 12 is a generally lightweight, durable structure configured to define the plurality of compartments 20. In one implementations, the pack body 12 is formed of a flexible, durable, wear resistant and tear resistant material such as a textile, a nylon, a premium fabric, a silicone coated fabric, a polyester yarn and combinations thereof. In other implementations, other fabrics, textiles and/or yarns can be used. In other implementations, the pack body can be formed as a rigid shell formed of a lightweight, durable, rigid material. The pack body 12 can include one or more pockets 22, closures 24, lids 26, handles 28, fitting straps 30, drawstrings 32, other features, and combinations thereof.

The back panel 14 is coupled to the pack body 12 and provides additional structure and support to the backpack 10. In one implementation, the back panel 14 is formed of a lightweight, durable and generally rigid material, such as a high density polyethylene foam positioned adjacent one or more layers of fiber composite material. In particular implementations, the back panel 14 material can be breathable. In other implementations, the back panel 14 can be formed of other materials, such as, other polymeric materials, other high density foams, plastics, composite materials, fiber composite materials, aluminum, other metals, wood, and combinations thereof. The back panel 14 can be curved to conform to a user's back. The back panel 14 includes a forward facing surface 34 for engaging the user's back. In one implementation, the back panel 14 can be entirely enclosed within the pack body 12 such that the pack body 12 contacts the user. In other implementations, a portion of the surface 34 of the back panel 14 can be exposed for direct engagement with the user. The back panel 14 can be coupled to the pack body 12 through one or more adhesives, stitching, straps, pocketing, and combinations thereof. In one implementation, a portion of the pack body can extend through the back panel to secure the back panel 14 to the pack body 12.

Figure 3A:
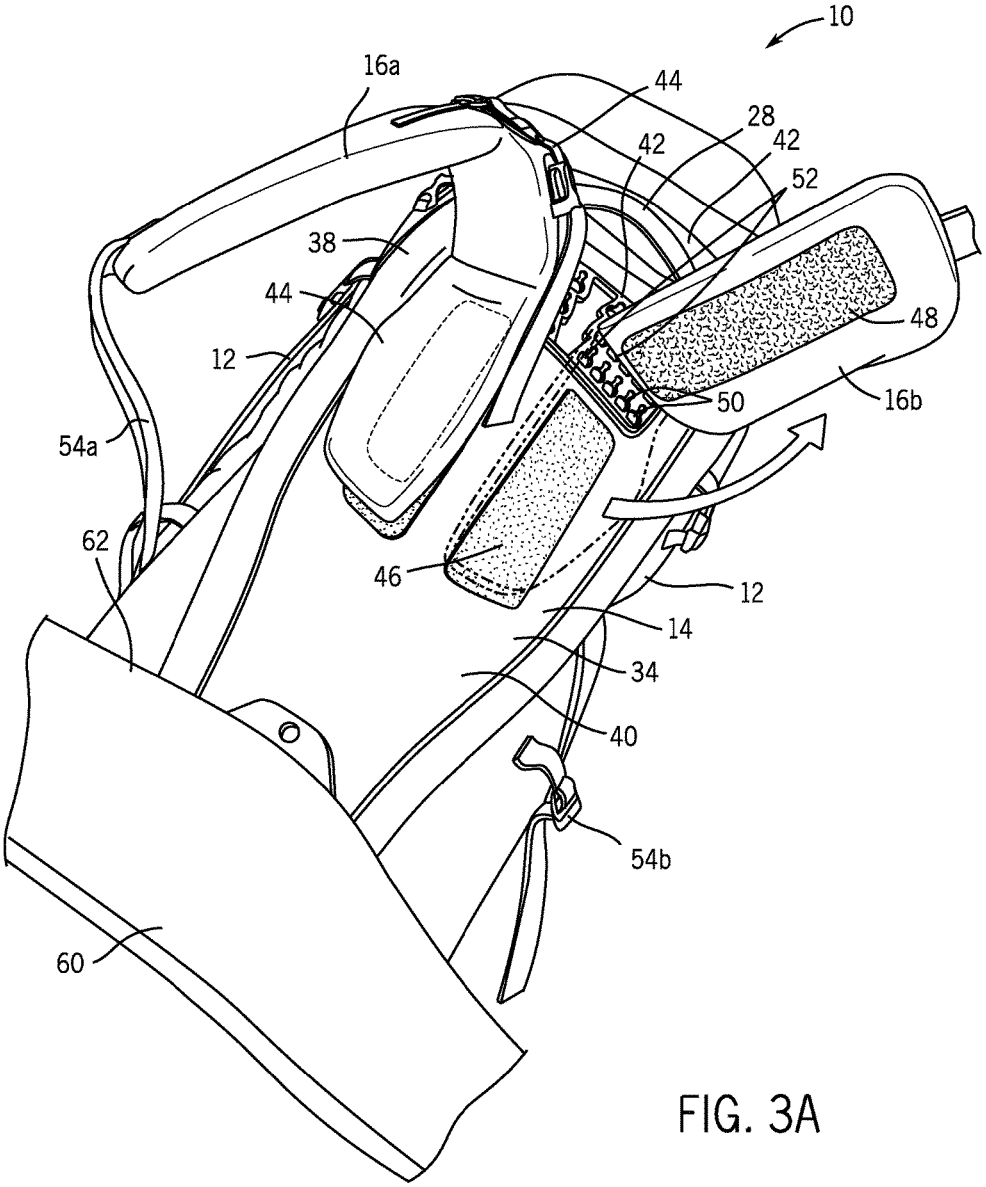
FIG. 3A is a front, side perspective view of the forward surface of the backpack of FIG. 1 shown off of the user.
Figure 4:
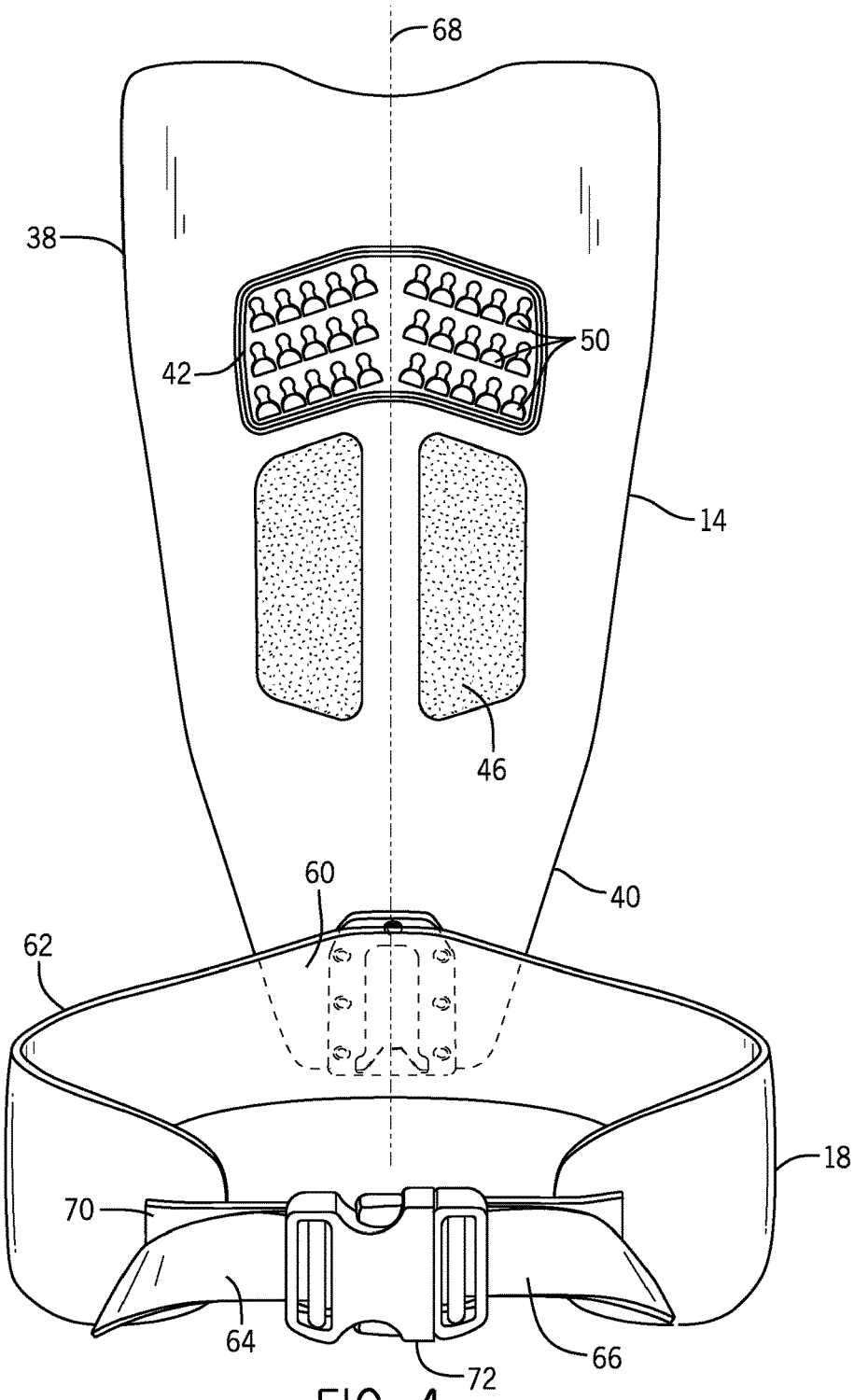
FIG. 4 is a front perspective view of a backpack suspension system of the backpack of FIG. 1.

The back panel 14 includes upper and lower regions 38 and 40. The shoulder straps 16*a* and 16*b* can be coupled to the upper region 38 and the hipbelt 18 can be coupled to lower region 40. Referring to FIGS. 3A and 4, in one implementation, the upper region 38 of the back panel 14 can include one or more fasteners 42 for releasably engaging an upper region 44 of the shoulder strap 16*a* or 16*b*. The upper region 38 of the back panel can include a pair of hook and/or loop fastening elements 46 for releasably engaging corresponding hook and/or loop fastening elements 48 positioned on the shoulder straps 16*a* and 16*b*. In other implementations, other forms of releasable fastening elements, such as snaps, can be used in lieu of hook and/or loop fastening elements. In one particular implementation, the fasteners 42 can be a plurality of slots 50 for releasably retaining projections 52 extending from the upper region 44 of the shoulder straps 16. The plurality of slots 50 enable the connection points of the shoulder straps 16*a* and 16*b* to the back panel 14 to be readily adjusted in height and width with respect to each other. In another implementation, the shoulder straps 16*a* and 16*b* can be fixedly and non-releasably secured to the back panel 14 without the releasable fastening elements 46, 48, 50 and 52. In another implementation, the shoulder straps 16*a* and 16*b* can be connected directly to the pack body 12.

The shoulder straps 16*a* and 16*b* are flexible, adjustable, durable supports configured to extend over the user's shoulders. In one implementation, the shoulder straps 16*a* and 16*b* are padded and contoured to conform to the user's body. In one implementation, the shoulder straps are formed of a flexible, durable material such as, for example, a nylon, a silicone treated polyurethane, an air textured polyester yarn, an open cell polyurethane foam, and combinations thereof. In other implementations, the shoulder straps can be formed of other textiles, foams and/or polymeric materials. The shoulder straps 16*a* and 16*b* include webbings 54*a* and 54*b* that connect the shoulder straps 16*a* and 16*b* to a lower portion of the pack body 12. Referring to FIG. 1, in one implementation, the backpack 10 further includes a modular sternum strap 58 extending between the shoulder straps 16*a* and 16*b* to provide additional stability to the backpack 10. The sternum strap 58 is formed of an adjustable webbing and includes a releasable fastener readily accessible to the user for easy connection and release.

Figure 3B:
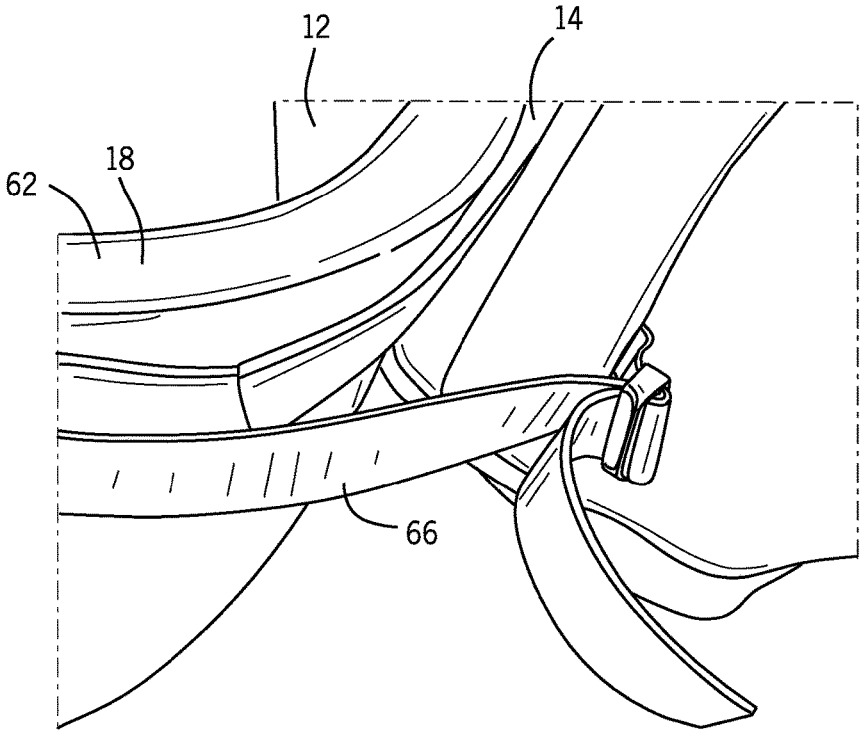
FIG. 3B is front, side perspective view of a portion of a hipbelt engaging a portion of the backpack of FIG. 1.

Referring to FIGS. 3A, 3B and 4, the hipbelt 18 is shown in greater detail. The hipbelt 18 is a support band configured to extend from the lower region 40 of the back panel 14 around the hips and/or waist of the user to provide additional support of the pack body 12 during use. In one implementation, the hipbelt 18 includes a pack coupling region 60, a padded region 62, a fastening region 64 and a pair of hipbelt stabilizer straps 66. The hipbelt 18 is coupled to the back panel 14 and the pack body 12 at the pack coupling region 60. In one implementation, the pack coupling region 60 is centered about a longitudinal axis 68 of the back panel 14 at the rear of the hipbelt 18 (and of the user). The padded region 62 extends from the pack coupling region 60 and around each side of the user and transitions to the fastening region 64 at the front of the hipbelt 18. In one implementation, the padded region 62 is a thermoformed pad formed of an open cell foam covered by a durable textile. The thermoformed pad of the padded region 62 gives the hipbelt 18 a curvature that facilitates the releasable attachment of the hipbelt 18. The padded region 62 can also be configured with one or more slots 70 for receiving the stabilizer straps 66. The padded region can have a height that is greater than the thickness of the straps 66 to provide additional support and comfort to the user. In one implementation, the maximum height of the padded region 62 is within the range of 2 to 8 inches. In one particular implementation, the padded region has a maximum height within the range of 4 to 6 inches. The fastening region 64 is formed by a fastener 72 attached to the distal ends of the stabilizer straps 66. In one implementation, the fastener 72 is a quick-release buckle. In other implementations, other types of releasable fasteners can be used. The stabilizer straps 66 extend from opposite sides of the pack body 12 extend through the slots 70 of the padded region 62 and are releasably connected at the fastener 72. The length of the straps 66 is adjustable. In another implementation, the stabilizer straps 66 are formed by four strap segments, with the first pair of segments extending from the pack body 12 to the padded region 62, and the second pair of segments extending from opposite ends of the padded region 62 and are releasably connected at the fastener 72.

Figure 5:
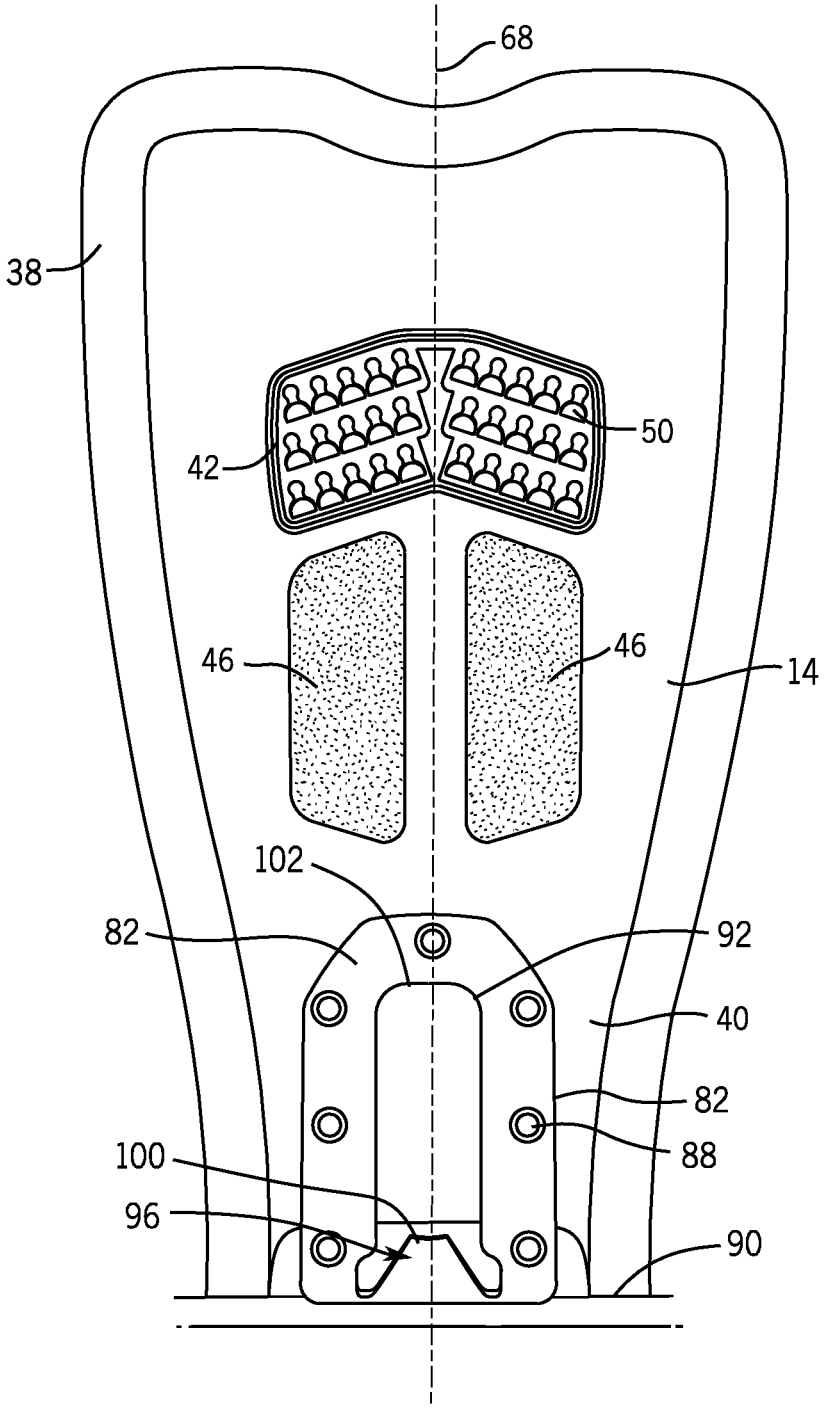
FIG. 5 is a front view of the backpack of FIG. 3 with the hipbelt removed from the backpack.
Figure 6:
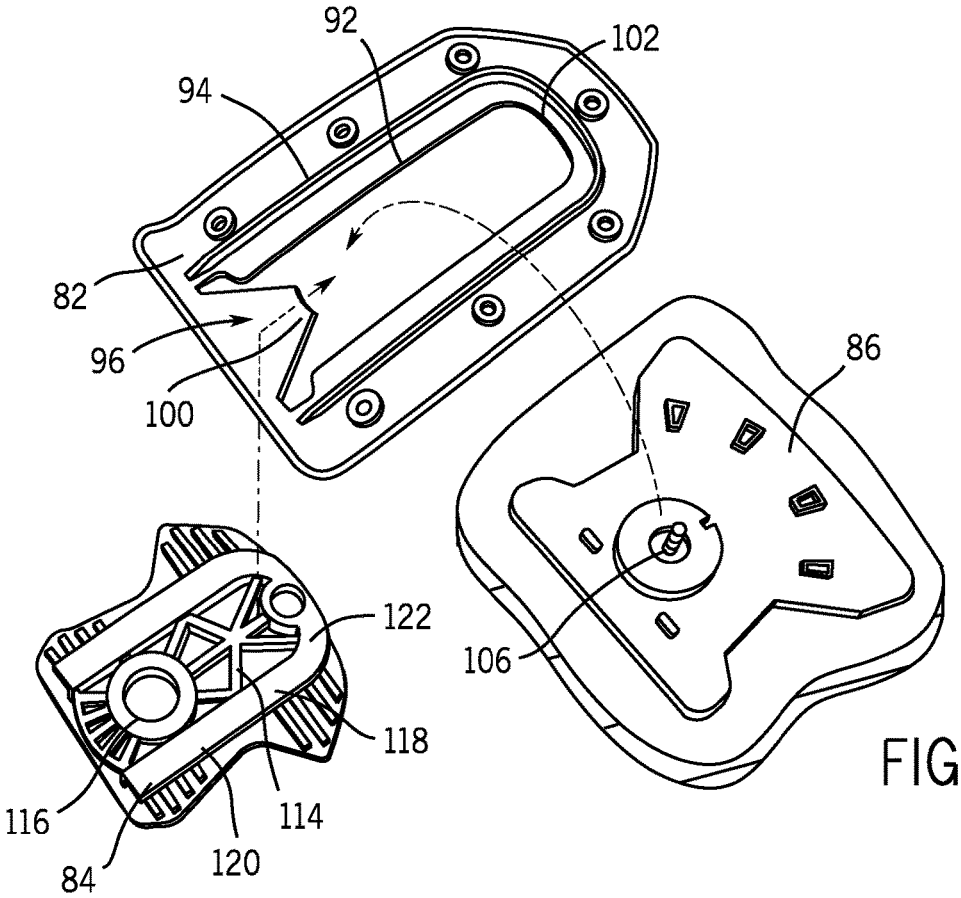
FIG. 6 is a top perspective view of the components of a hipbelt coupling assembly of the backpack of FIG. 1.

Referring to FIGS. 5 through 12, a hipbelt coupling assembly 80 is shown. Referring to FIG. 6, the hipbelt coupling assembly 80 includes a back panel support 82, a hipbelt coupling element 84 and a hipbelt support plate 86.

Referring to FIGS. 5 and 6, the back panel support 82 is a bracket coupled to the lower region 40 of the back panel 14. In one implementation, the support 82 is coupled to the back panel 14 by a plurality of fasteners 88. In other implementations, the support 82 can be coupled to the back panel 14 through adhesives, co-molding, bonding, being formed integrally with the back panel and combinations thereof. In one implementation, the support 82 is centered about the longitudinal axis 68 and positioned such that the support 82 extends to, and is generally in line with, a lower edge 90 of the back panel 14. In other implementations, the support 82 can be formed as two supports coupled to the back panel in a manner that is spaced apart from the axis 68. The support 82 defines an elongate engagement region. In one implementation, the elongate engagement region is an elongate opening 92, and includes at least one ridge 94 and a tang 96 projecting into the opening 92. The elongate opening 92 is sized to receive at least a portion of the hipbelt coupling element 84. The at least one ridge 94 extends about at least a portion of the perimeter of the opening 92. The tang 96 extends into the opening from a lower region 103 of the support 82 to form a first stop 100. A second stop 102 is formed by the opposite end of the opening 92.

Figure 7:
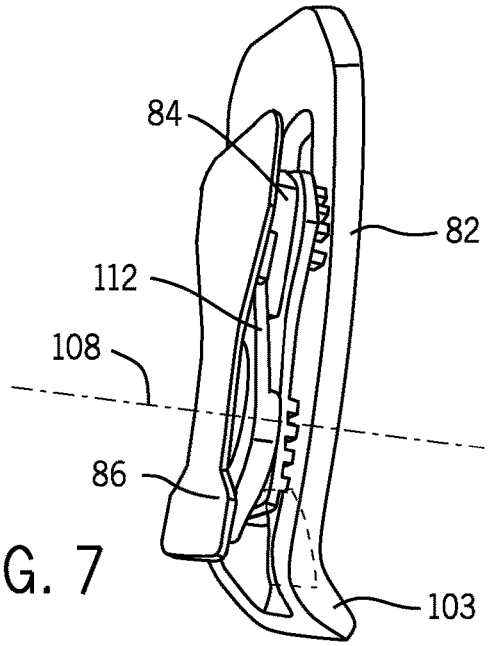
FIG. 7 is a side perspective view of the hipbelt coupling assembly of FIG. 6 shown apart from the backpack.
Figure 8:
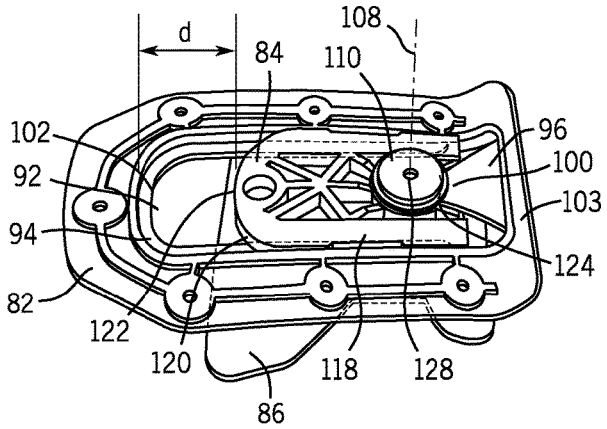
FIGS. 8 through 11 are rear, side perspective views of the hipbelt coupling assembly of FIG. 7 shown in different positions.

Referring to FIGS. 6 through 8, the hipbelt support plate 86 is coupled to the pack coupling region 60 of the hipbelt 18. In one implementation, the hipbelt support plate 86 is integrally formed within the hipbelt 18 and internally secured to the pack coupling region 60 through stitching, straps, pocketing, adhesives, or other fastening mechanisms. In another implementation, the support plate 86 can be attached to an outer or rear surface of the hipbelt 18. The support plate 86 can include a shaft 106 outwardly projecting from the plate 86. The shaft 106 defines a pivot axis 108. In one implementation, the shaft 106 is a threaded shaft that extends through the hipbelt coupling element 84 and engages a circular nut 110. In other implementations, the threaded shaft 106 and nut 110 can be replaced by other forms of fasteners, such as, for example, a pinned shaft, a rivet, and other fastening mechanisms. The plate 86 is sized and shaped to support the shaft 106 during use.

The hipbelt coupling element 84 is a generally planar body having a forward surface 112, a rearward surface 114 and including an aperture 116 for receiving the shaft 106 and/or the nut 110. In one implementation, the coupling element 84 includes at least one generally L-shaped projection 118 extending from the rearward surface 114 to form at least one channel 120 for movably receiving the at least one ridge 94. In other implementations, the at least one channel 120 can be formed by other shapes within the coupling element 84. In one implementation, the at least one channel 120 is a single U-shaped channel sized to slidably receive and engage the ridge 94. The U-shaped channel forms a first end 122. The aperture 116 is sized to receive the nut 110, and the nut 110 can form a second end 124. The distance between the first and second ends 122 and 124 in combination with the length of the coupling element 84 define an operable length of the coupling element 84. The operable length is less than the length (or major dimension) of the opening 92. According referring to FIGS. 8 and 9, the coupling element 84 is received within the opening 92 of the support 82 such that the ridge 94 engages the channel 120. The engagement of the ridge 94 and the channel 120 enables translational movement of the coupling element 84 between the first and second stops 100 and 102. The coupling element 84 and the support 82 are sized and shaped to enable the coupling element 84 to slide, move or translate within the opening by a dimension or distance d. In one implementation, the distance d is within the range of 0.5 to 6.0 inches. In another implementations, the distance d is within the range of 1.0 to 4.0 inches. The engagement of the ridge 94 and the channel 120 also connects the support 82 and the back panel 14 to the coupling element 84. In another implementation, the support can include one or more channels and the coupling element can include one or more ridges to correspond with and engage the one or more channels.

The support 82, the coupling element 84 and the plate 86 can formed of a generally rigid material, such as a plastic. In other implementations, the support 82, the coupling element 84 and the plate 86 can be formed of other materials such as, for example, other polymeric materials, a fiber composite material, aluminum, wood, and combinations thereof.

Figure 9:
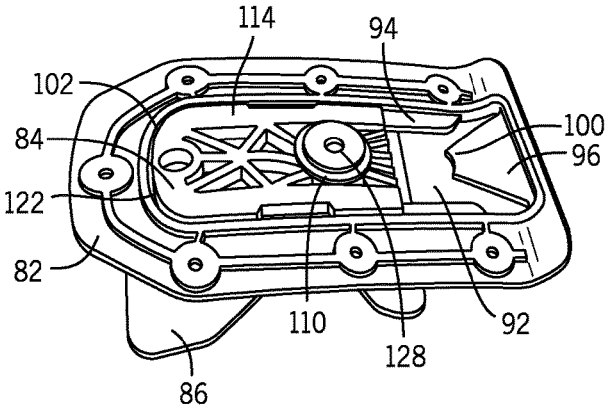

Referring to FIG. 8, the circular nut 110 can include an enlarged head 128 having a curved outer surface for engaging the first stop 100 of the tang 96. In FIG. 8, the coupling element 84 is shown with the nut 110 engaging the first stop 100. Referring to FIG. 9, the coupling element 84 is shown with the first end 122 of the channel 120 engaging the second stop 102 of the support 82.

Figure 10:
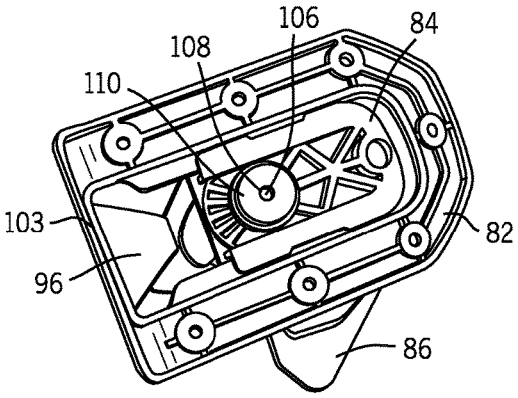
Figure 11:
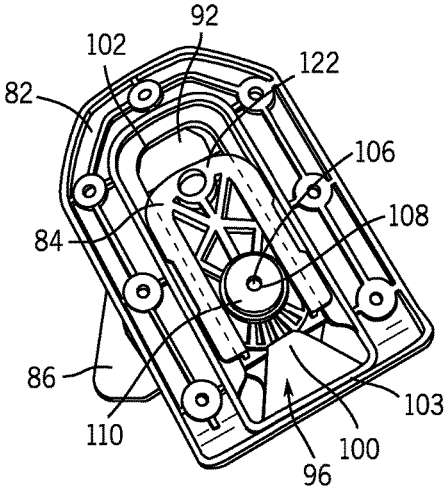

Referring to FIGS. 10 and 11, the coupling element 84 is shown in first and second angled positions about the pivot axis 108 with respect to the support plate 86. The shaft 106 extends through the aperture 116 to engage the nut 110. The head 128 of the nut 110 and its threaded engagement to the shaft 106 provide the pivotable couples the support plate 86 to the coupling element 84. In one implementation, the pivotal coupling of the coupling element 84 to the hipbelt support plate 86 enables full rotation of the coupling element 84 about the shaft 106 and pivot axis 108. In other implementations, one or both of the coupling element 84 and the support plate 86 can include restricting elements to limit the rotation of the coupling element about the axis 108. In one implementation, the coupling element 84 and the support plate 86 can be configured to enable rotation up to 270 degrees about the axis 108. In another implementation, the coupling element 84 and the support plate 86 can be configured to enable rotation up to 180 degrees about the axis 108. In another implementation, the coupling element 84 and the support plate 86 can be configured to enable rotation up to 120 degrees about the axis 108.

Figure 12A:
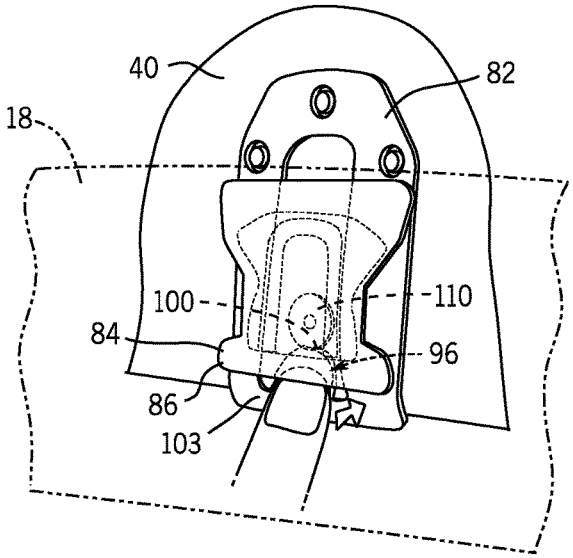
FIGS. 12A and 12B are rear views of the hipbelt coupling assembly of FIG. 7 with the hipbelt attached to, and separated from, a back panel support of the hipbelt coupling assembly.
Figure 12B:
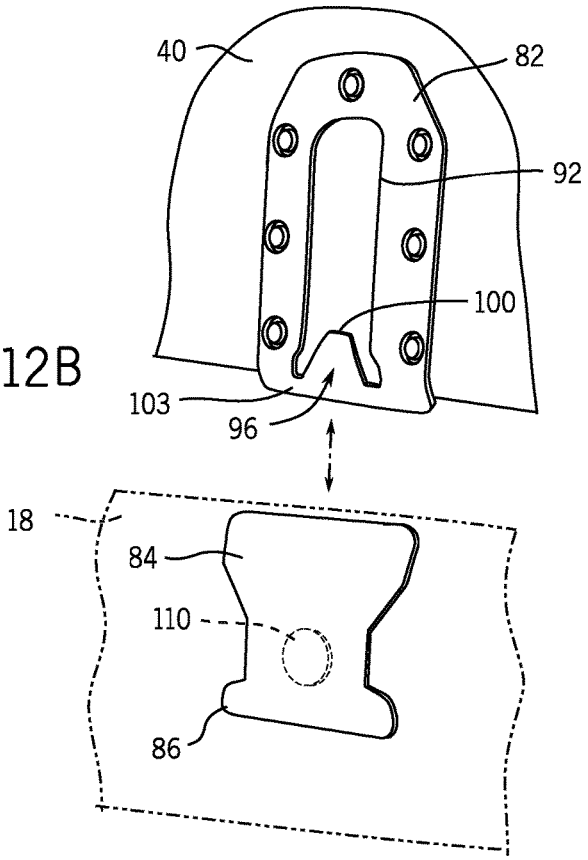

Referring to FIGS. 12A and B, the hipbelt coupling element 84 can be releasably engaged with the back panel support 82. In one implementation, the coupling element 84 can be released from the support 82 by depressing and deflecting the tang 96 to reposition the first stop 100 and to allow the coupling element 84 to slidably disengage from the support 82. Once released or disengaged, the tang 96 can resiliently move back to its original position. In one implementation, the lower region 103 of the support 82 can be advantageously curved in a direction away from the user (or from the hipbelt 18) to facilitate the slidable disengagement and subsequent re-engagement of the coupling element 84 to the support 82. To re-engage the hipbelt 18 to the pack 10, the user simply positions the coupling element 84 at the lower region 103 of the support 82 and moves the coupling element 84 toward the ridge 94 of the support 82. The movement of the coupling element 84 engages and deflects the tang 96 to enable the channel 120 of the coupling element 84 to slidably re-engage the ridge 94. Once the coupling element 84 extends fully past the tang 96, the tang 96 resiliently deflects or moves back to position. In other implementations, the resilient tang 96 can be configured to repositionable rather than resiliently deflectable. The releasable engagement or coupling of coupling element 84 and the support 82 enables the user to readily remove the pack 10 from the hipbelt 18 as desired.

Referring to FIGS. 13 through 16, an alternative implementation of the hipbelt suspension system 150 is illustrated. The hipbelt suspension system 150 includes a hipbelt coupling assembly 152. The hipbelt coupling assembly 152 includes the back panel support 82, a hipbelt coupling element 184, first and second webbings 156 and 158, and a dowel pin 160. The first and second webbings 156 and 158, and the dowel pin 160 are utilized in lieu of the hipbelt support plate 86.

Figure 13:
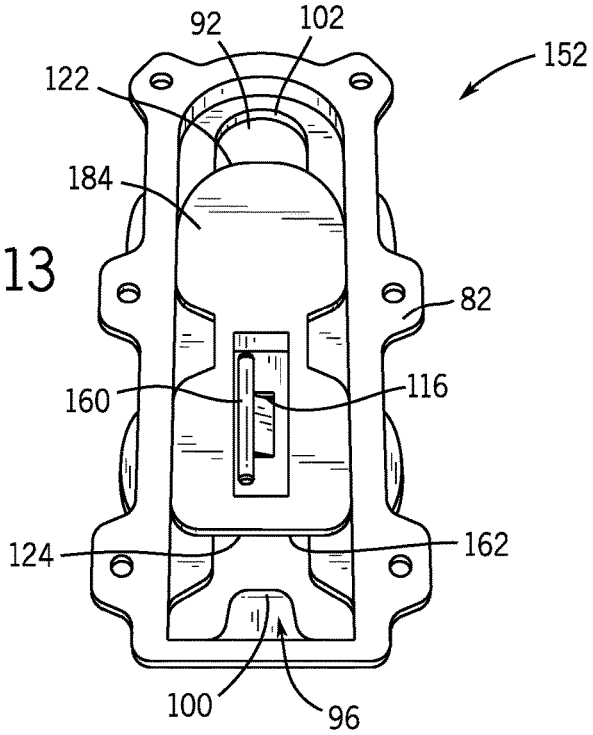
FIG. 13 is a perspective view of a hipbelt coupling element engaged with a hipbelt support bracket in accordance with an alternative implementation of the present invention.

The hipbelt coupling element 184 is substantially similar to the hipbelt coupling element 84 except the aperture 116 is sized and shaped to receive a first end 170 of the first webbing 156. The coupling element 184 also includes a lower end region 162 that serves as the second end 124 and slidably engages the stop 100. FIG. 13 illustrates the coupling element 184 positioned in an intermediate vertical position between the first and second stops 100 and 102 of the support 82. The coupling element 184, like coupling element 84, slidably moves about, or with respect to, the support 82 between the first and second stops 100 and 102 to provide vertical movement of the pack 10 with respect to the hipbelt 18.

Figure 14:
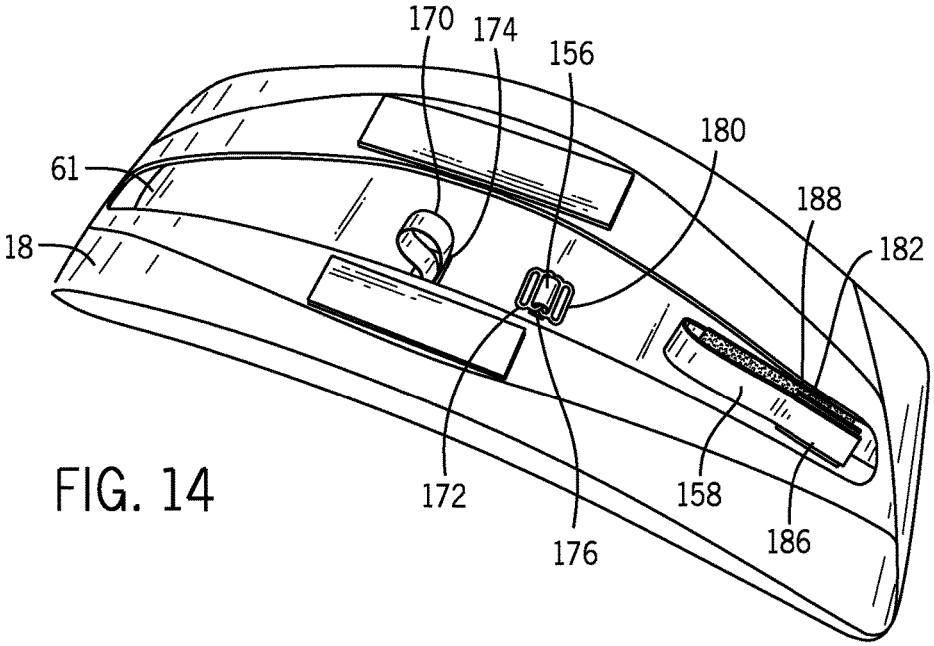
FIG. 14 is a rear view of a hip belt without a pack or a hipbelt coupling element in accordance with the alternative implementation of the present invention of FIG. 13.
Figure 15:
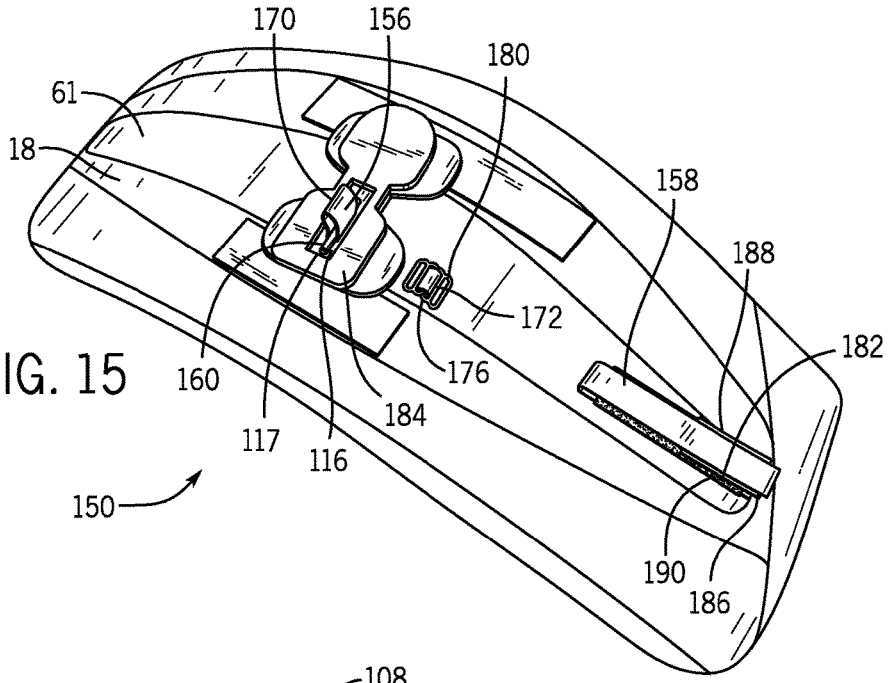
FIGS. 15 and 16 illustrate the attachment of the hipbelt coupling element of FIG. 13 to the hipbelt of FIG. 14.

Referring to FIGS. 14 and 15, the first and second webbings 156 and 158 are illustrated positioned along the back side of the hipbelt 18. The first webbing 156 includes the first end 170 and a second end 172. The rear side of the hipbelt 18 can include a curved, generally rigid support member 61 defining first and second slots 174 and 176. The support member 61 can be formed of a fiber composite material or other lightweight, generally-rigid material. In other implementations, the support member 61 can take other shapes or sizes. In another implementation, support member 61 can be positioned within the hipbelt 18 so as not to visible to a user. In one implementation the first webbing 156 is threaded through first and second slots 174 and 176 of the support member 61. The first end 170 of the first webbing 156 can include a loop for receiving the dowel pin 160 after having passed through the aperture 116 of the coupling element 184. The second end 172 of the first webbing 156 can include a guide 180 or other fastening assembly for releasably and slidably engaging the second webbing 158. In one implementation, the first and second webbings 156 and 158 are formed of a non-stretch webbing material, such as a material comprising para-aramid fibers (e.g. Technora® by Teijin Ltd.) or ultra-high molecular weight polyethylene fibers (e.g. Dyneema® of DSM IP Asset B.V.). The non-stretchable, non-resilient webbing material enables the first and second webbings 156 and 158 to substantially retain their length during use, and not undesirably elongate or loosen during use, when pulled during initial fastening, or when subjected to moisture. In another implementation, the first and/or second webbing can be formed of other stretchable and/or resilient fibers, such as, for example, nylon or polyester.

The second webbing 158 includes first and second ends 182 and 184 and a corresponding pair of releasable fastener elements 186 and 188 attached near the first and second ends 182 and 184. The first end 182 is fixedly engaged to the support member 61 of the hipbelt 18 through stitching, pocketing, adhesives, other fastening mechanisms or combinations thereof. The second end 184 extends through the guide 180 and back toward the first end 182 for releasable engagement of the fastener elements 186 and 188. In one implementation, the fastener elements 186 and 188 are hoop and loop fastening elements. In other implementations other forms of fasteners can be used on the second webbing 158.

Figure 16:
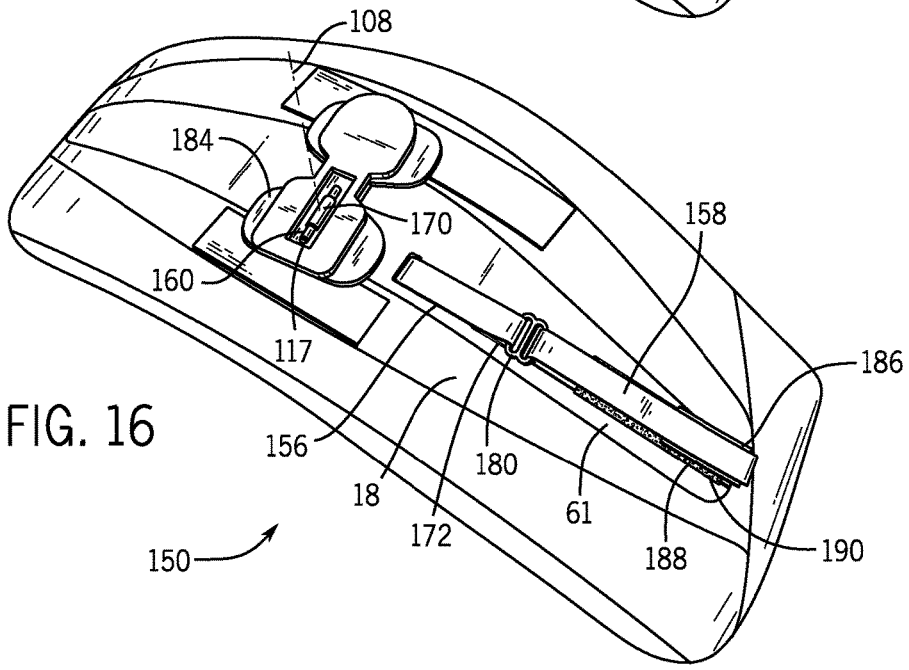

Referring to FIGS. 15 and 16, the coupling element 184 is releasably attached to the hipbelt 18 by use of the first and second webbings 156 and 158 and the dowel pin 160. The first webbing 156 extends through the first and second slots 174 and 176 with the first end 170 forming a looped end extending through the aperture 116 to receive the dowel pin 160. The dowel pin 160 is an elongate rod with a longitudinal dimension that is greater than the length of the aperture 116. The dowel pin 160 is formed of a lightweight, rigid material such as, for example, a fiber composite material. In other implementations, the dowel pin can be formed of other lightweight rigid materials such as wood, aluminum, a plastic, or other materials. Accordingly, when the dowel pin 160 is positioned through the looped first end 170 of the first webbing 156 and the second end 172 is pulled, the dowel pin 160 engages and bears against the coupling element 184 preventing the first end 170 from being pulled back through the aperture 116, and retaining the coupling element 184 against the hipbelt 18. A recessed region 117 is formed in the outer surface of the coupling element 184 for retaining the dowel pin 160 in a substantially vertical position when in an engaged positioned with the first and second webbings 156 and 158. In other implementations, the dowel pin 160 can be attached to the first webbing in other manners, for example the first end can be formed with an enlarged head that takes the place of the dowel pin and eliminates the need for a looped first end. The dowel pin 160 and the recessed region 117 are generally aligned in a vertical position. In other implementations, the dowel pin and recessed region can be arranged in different positions, or the recessed region can be eliminated.

The guide 180 is fixed to the second end 172 of the first webbing 156 and provides one or more loops for receiving the second end 186 of the second webbing 158. The second webbing 158 is fixed at its first end 182 to the hipbelt 18. The second end 186 of the second webbing 158 is threaded through the guide 180 and then pulled taut by the user. Once pulled to a sufficient tension, the second end 186 can be releasably fastened to the first end 172 of the second webbing 158 through the engagement of the first and second fastening elements 188 and 190. The pulling of the second end 186 of the second webbing 158 tensions the first webbing 156 thereby securing the coupling member 184 in place against the hipbelt 18.

The first and second webbings 156 and 158 and the dowel pin 160 provides another hipbelt attachment mechanism that is a lightweight, durable mechanism for securely attaching the coupling element 184 to the hipbelt 18. This implementation eliminates the formation of a raised area or bump within the hipbelt 18 that can be formed by some configurations of rigid fasteners or support plates within the hipbelt 18. Such a raised region could cause discomfort to the wearer. The first webbing 156 extends through the hipbelt 18 forming no raised or hardened regions within the hipbelt 18. Further, the first and second webbings 156 and 158 and the dowel pin 160 provide a fastening mechanism that allows for rotational movement of the coupling element 184 with respect the pack body 12 generally about the axis 108. The rotational movement provided by the first end 170 of the first webbing is controlled or resisted to some degree by the shape and configuration of the first webbing 156. Further, the generally vertical orientation of the dowel pin 160 within the recessed region 117 of the coupling element 184 and the properties of the first webbing 156 tend to bias the first end 170 of the first webbing 156 toward the vertical position facilitating the return, leveling or centering of the hipbelt 18 when the rotational load is removed from the hipbelt during use. Accordingly, although the coupling element 184 is free to rotate with respect to the hipbelt 18 during use, the rotation is loose and includes some degree of resistance. Further, the first and second webbings 156 and 158 and the dowel pin 160 provide a highly reliable, durable, easy to use and cost effective solution for the rotational coupling of the coupling element 184 to the hipbelt 18.

Figure 17:
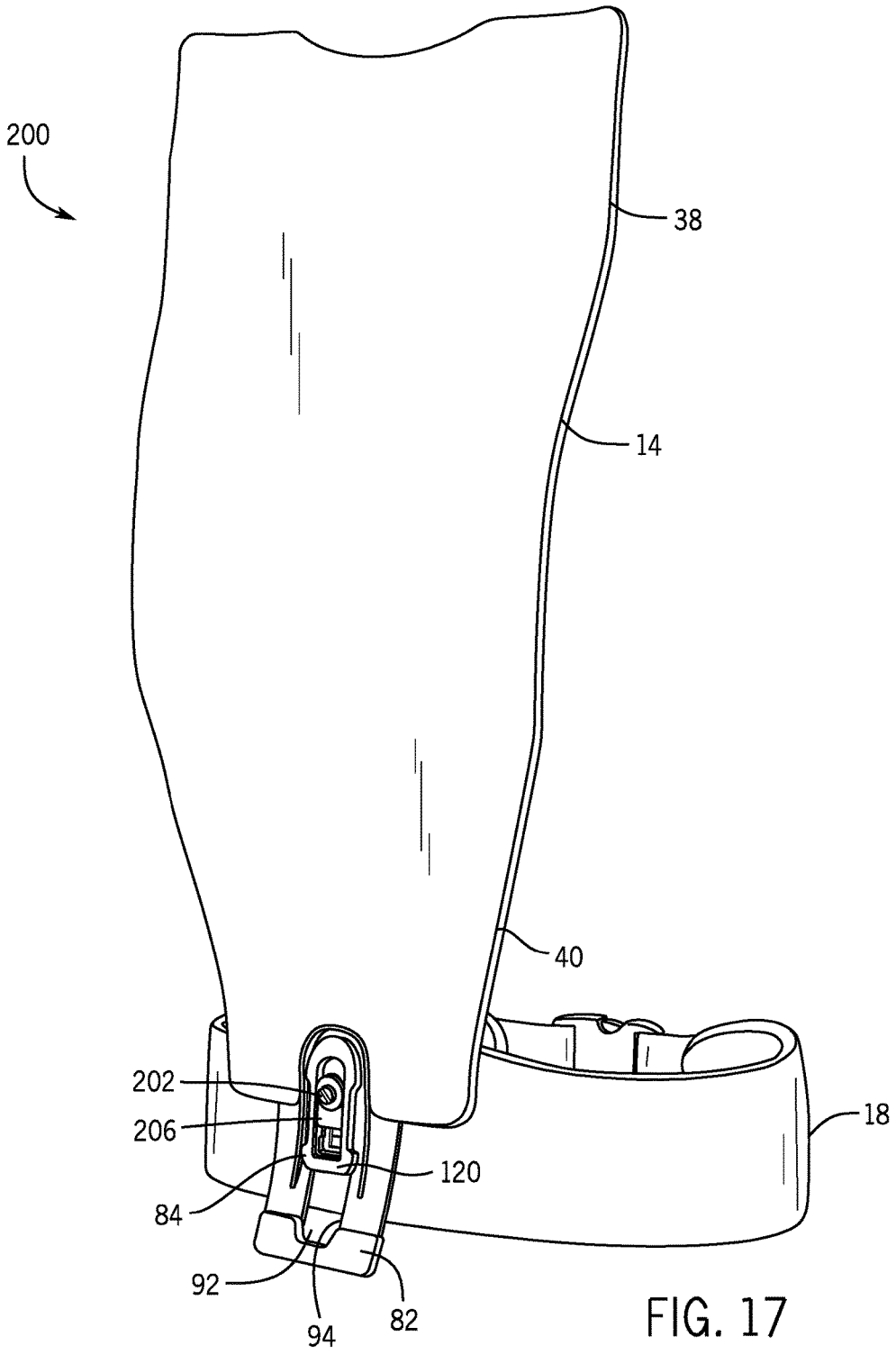
FIG. 17 is a rear, side perspective view of a hipbelt suspension system in accordance with an alternative implementation of the present invention.
Figure 18:
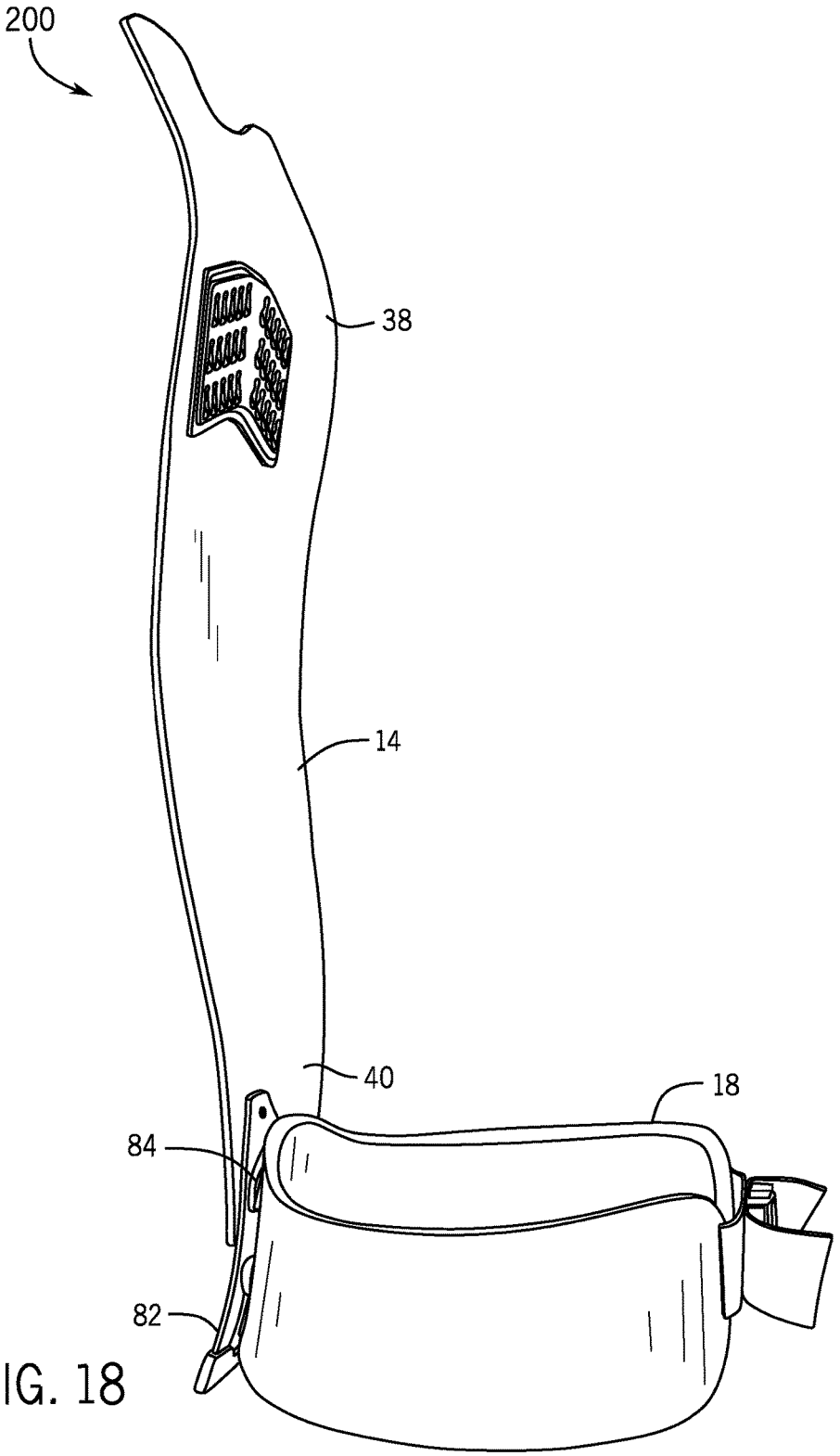
FIG. 18 is a side perspective view of the hipbelt suspension system of FIG. 17.

Referring to FIGS. 17 through 18, another implementation of the hipbelt suspension system 200 is illustrated. The elements of the hipbelt suspension system 200 are substantially similar to the elements disclosed above with respect to the backpack 10. In the present implementation, the back panel support 82 can extend beyond or beneath the lower region 40 of the back panel 14. The extension of the support 82 beyond or beneath the back panel 14 provides greater flexibility and the ability utilized a small back panel 14, if desired. In the present implementation, the back panel support 82 has a more gradual and larger curvature away from the hipbelt 18. Referring to FIG. 17, the at least one channel 120 of the coupling element 84 can be three or more spaced about channels positioned to engage the ridge 94 about the opening 92 of the support 82. Additionally, the hipbelt support plate 86 can be connected to a rear surface of the pack coupling region 60 of the hipbelt 18.

Figure 19:
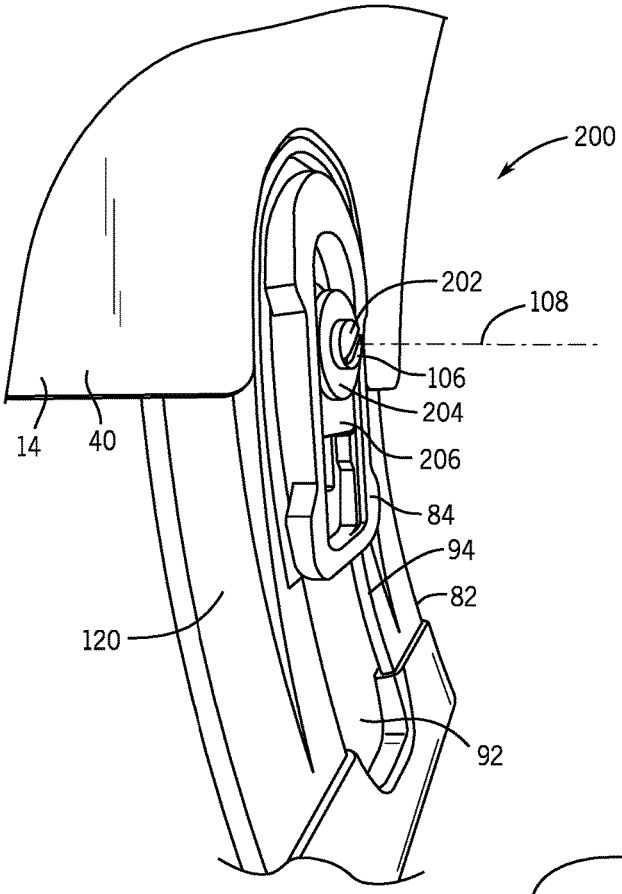
FIG. 19 is a side perspective view of a hipbelt coupling assembly of the hipbelt suspension system of FIG. 17
Figure 20:
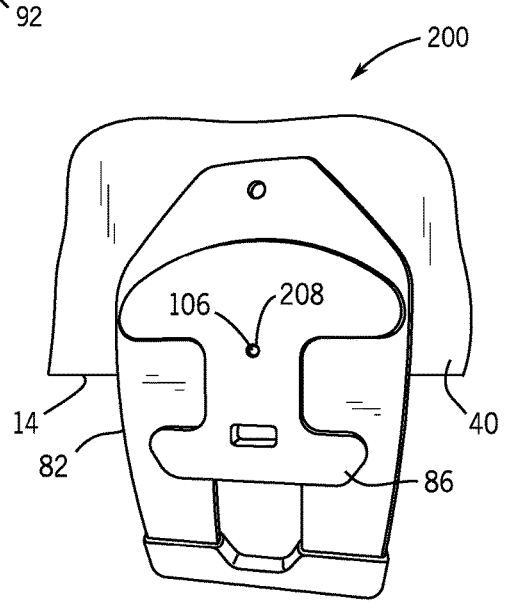
FIG. 20 is forward side perspective view of the hipbelt coupling assembly of FIG. 19.

Additionally, the coupling of the coupling element 84 to the hipbelt support plate 86 can be accomplished through an alternative fastening arrangement. In the implementation of FIGS. 17-19, the shaft 106 can be a threaded screw 202 extending through a washer 204, a spacer 206, and the coupling element 84 where it threadedly engages an aperture 208 in the hipbelt support plate 86. The screw 202 can include a smooth bearing surface to facilitate rotation of the coupling element 84 with respect to the plate 86, and a threaded portion for engaging the coupling support plate 86. In one implementation, the screw 202 can also be configured to extend through the plate 86 to connect to the hipbelt 18. The coupling of this implementation also provides the ability for the hipbelt coupling element 84 to rotate completely about the axis 108 of the shaft 106.

The present invention provides a hipbelt suspension system for a backpack that provides enhanced flexibility and comfort for the user. The hipbelt suspension system enable rotation and upward/downward movement of the pack body 12 during use to eliminate binding and stress points on the user's hips, particularly when trekking or hiking while carrying a heavily loaded pack 10. The hipbelt suspension system of the present invention distributes the load on the user's hips and prevents discomfort from small upward/downward motion of the user, particularly when traveling on uneven terrain.

While the preferred embodiments of the invention have been illustrated and described, it will be appreciated that various changes can be made therein without departing from the spirit and scope of the invention. One of skill in the art will understand that the invention may also be practiced without many of the details described above. Accordingly, the present invention is intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A backpack assembly for a user, the system comprising:

a back panel including an upper region and a lower region;

a pack body coupled to the back panel, the body including one or more compartments;

a back panel support coupled the lower region of the back panel, the back panel support including an elongate engagement region having opposing first and second stops;

a hipbelt coupling element movably engaging the elongate engagement region of the back panel support such that, when being worn by the user, the coupling element is free to move anywhere along a first distance between the first and second stops of the engagement region; and a hipbelt including a hipbelt attachment mechanism, the hipbelt attachment mechanism pivotally coupled to the hipbelt coupling element about a first axis.

2. The backpack assembly of claim 1, wherein the hipbelt attachment mechanism includes a hipbelt support plate, and further comprising at least one fastener extending along the first axis pivotally coupling the hipbelt support plate to the hipbelt coupling element.

3. A backpack assembly for a user, the system comprising:

a back panel including an upper region and a lower region;

a pack body coupled to the back panel, the body including one or more compartments;

a back panel support coupled the lower region of the back panel, the back panel support including an elongate engagement region having opposing first and second stops;

a hipbelt coupling element movably engaging the elongate engagement region of the back panel support such that the coupling element is free to move between the first and second stops of the engagement region; and a hipbelt including a hipbelt attachment mechanism, the hipbelt attachment mechanism pivotally coupled to the hipbelt coupling element about a first axis, wherein the pivotal coupling enables 360 degrees of rotation about the first axis of the hipbelt coupling element with respect to the hipbelt.

4. The backpack assembly of claim 1, wherein the elongate engagement region enables free translational movement of the hipbelt coupling element during use between the first and second stops.

5. The backpack assembly of claim 2, wherein the hipbelt support plate is generally planar, and the first axis is substantially perpendicular to the hipbelt support plate.

6. The backpack assembly of claim 1, wherein the engagement region of the support and the coupling element are sized to enable the coupling element to freely move while being worn by the user along the first distance between the first and second stops, and wherein the first distance is within the range of 0.5 to 6.0 inches.

7. The backpack assembly of claim 6, wherein the first distance is within the range of 1.0 to 4.0 inches.

8. The backpack assembly of claim 1, wherein one of the back panel support and the hipbelt coupling element include at least one elongate ridge, and wherein the other of the back panel support and the hipbelt coupling element includes at least one elongate channel for engaging the at least one elongate ridge.

9. The backpack assembly of claim 8 wherein engagement of the at least one ridge with the at least one elongate channel inhibits separation of the hipbelt coupling element from the back panel support.

10. The backpack assembly of claim 8, wherein one of the first and second stops is selectably movable by the user to enable the user to disengage the hipbelt coupling element from the back panel support.

11. The backpack assembly of claim 1, wherein the pivotal coupling enables 180 degrees of rotation about the first axis of the hipbelt coupling element with respect to the hipbelt.

12. The backpack assembly of claim 1, wherein the back panel includes a lower edge, and wherein the back panel support extends beyond the lower edge.

13. The backpack assembly of claim 1, further comprising a pair of shoulder straps coupled to the upper region of the back panel, wherein the upper region of the back panel includes a plurality of spaced apart shoulder strap attachment locations, and wherein each of the shoulder straps is removably positionable between two or more spaced apart locations on the upper region.

14. The backpack assembly of claim 1, further comprising at least one hipbelt stabilizer strap adjustably extending between the hipbelt and the pack body.

15. A backpack assembly for a user, the system comprising:

a back panel including an upper region and a lower region;

a pack body coupled to the back panel, the body including one or more compartments;

a back panel support coupled the lower region of the back panel, the back panel support including an elongate engagement region having opposing first and second stops;

a hipbelt coupling element movably engaging the elongate engagement region of the back panel support such that the coupling element is free to move between the first and second stops of the engagement region; and a hipbelt including a hipbelt attachment mechanism, the hipbelt attachment mechanism pivotally coupled to the hipbelt coupling element about a first axis, wherein the hipbelt attachment mechanism includes first and second webbings and a dowel pin.

16. A hipbelt suspension system for use with a backpack of a user having a back panel, the suspension system comprising:

a back panel support coupled a lower region of the back panel, the back panel support including an engagement region having opposing first and second stops;

a generally planar hipbelt coupling element movably engaging the engagement region of the back panel support to enable free translational movement of the hipbelt coupling element between the first and second stops of the engagement region of the back panel when the backpack and the suspension system are being worn by the user;

a hipbelt attachment mechanism pivotally coupled to the hipbelt coupling element about a first axis; and a hipbelt secured to the hipbelt attachment mechanism.

17. The hipbelt suspension system of claim 16, wherein the pivotal coupling enables 360 degrees of rotation about the first axis of the hipbelt coupling element with respect to the hipbelt attachment mechanism.

18. The hipbelt suspension system of claim 16, wherein the hipbelt attachment mechanism includes first and second webbings and a dowel pin.

19. The hipbelt suspension system of claim 16, wherein the engagement region of the support and the coupling element are sized to enable the coupling element to move a first distance between the first and second stops, and wherein the first distance movably the distance between the first and second stops is within the range of 0.5 to 6.0 inches.

20. The hipbelt suspension system of claim 19, wherein the first distance is within the range of 1.0 to 4.0 inches.

21. The hipbelt suspension system of claim 16, wherein the back panel includes a lower edge, and wherein the back panel support extends beyond the lower edge.

22. The hipbelt suspension system of claim 16, wherein one of the back panel support and the hipbelt coupling element include at least one elongate ridge, and wherein the other of the back panel support and the hipbelt coupling element includes at least one elongate channel for engaging the at least one elongate ridge.

23. The hipbelt suspension system of claim 16 wherein engagement of the at least one ridge with the at least one elongate channel inhibits separation of the hipbelt coupling element from the back panel support.

24. The hipbelt suspension system of claim 16, wherein one of the first and second stops is selectably movable by the user to enable the user to disengage the hipbelt coupling element from the back panel support.

25. The backpack assembly of claim 1, wherein the pivotal coupling enables 120 degrees of unbiased rotation about the first axis of the hipbelt coupling element with respect to the hipbelt.

* * * * *